US010151476B2

(12) United States Patent
Brazier et al.

(10) Patent No.: US 10,151,476 B2
(45) Date of Patent: Dec. 11, 2018

(54) BOILER WITH ACCESS TO HEAT EXCHANGERS

(71) Applicant: Central Boiler, Inc., Greenbush, MN (US)

(72) Inventors: Dennis Brazier, Roseau, MN (US); Mark Reese, Greenbush, MN (US)

(73) Assignee: Central Boiler Inc., Greenbush, MN (US)

( * ) Notice: Subject to any disclaimer, the term of this patent is extended or adjusted under 35 U.S.C. 154(b) by 192 days.

(21) Appl. No.: 15/091,399

(22) Filed: Apr. 5, 2016

(65) Prior Publication Data

US 2016/0290747 A1 Oct. 6, 2016

Related U.S. Application Data

(60) Provisional application No. 62/143,646, filed on Apr. 6, 2015.

(51) Int. Cl.
*F24B 1/188* (2006.01)
*F22B 37/48* (2006.01)
(Continued)

(52) U.S. Cl.
CPC ..... *F22B 37/48* (2013.01); *F22B 37/38* (2013.01); *F28G 13/00* (2013.01)

(58) Field of Classification Search
CPC ..... F24H 1/187; F24H 2300/00; F24H 1/108; F24B 5/02; F24B 5/04; F24B 1/188; F24B 1/1886; F23M 7/00; F27D 1/1858
See application file for complete search history.

(56) References Cited

U.S. PATENT DOCUMENTS 4,334,518 A * 6/1982 Ort ..... F24B 1/18 126/502
4,479,605 A * 10/1984 Billotte ..... F24D 11/003 122/16.1
(Continued)

FOREIGN PATENT DOCUMENTS

CN 202040801 U 11/2011
EP 1627190 B1 7/2008
(Continued)

OTHER PUBLICATIONS

BioMass Gasification Boiler; New Horizon Corporation; pp. 4; Dated Dec. 10, 2014.
(Continued)

*Primary Examiner* — Gregory A Wilson
(74) *Attorney, Agent, or Firm* — Lowe Graham Jones PLLC

(57) ABSTRACT

A boiler that includes a housing is disclosed. The housing houses a combustion chamber, a heat exchanger system, a heat flow path, an isolating member, and a removable panel. The heat flow path thermally couples the combustion chamber and the heat exchanger system. The isolating member at least partially separates the combustion chamber from the heat exchanger system wherein. When the removable panel is removed a user is provided access to the heat exchanger system. The isolating member is internal to the housing. The removable panel is an internal removable panel positioned on the isolating member. When the internal removable panel is removed, the user is provided internal access to the heat exchanger system. In other embodiments, the panel is an external removable panel positioned on an exterior wall of the housing. When the exterior removable panel is removed, the user is provided exterior access to the heat exchanger system.

20 Claims, 6 Drawing Sheets

(51) Int. Cl.
*F22B 37/38* (2006.01)
*F28G 13/00* (2006.01)

(56) References Cited

U.S. PATENT DOCUMENTS 4,534,319 A * 8/1985 Manno ..... F24B 9/04 122/16.1
5,329,920 A * 7/1994 Brazier ..... F23M 7/00 122/16.1
6,892,679 B2 5/2005 Jameel et al.
6,938,582 B2 9/2005 Shin
7,264,039 B2 9/2007 Dawson
8,011,329 B2 * 9/2011 Hardy ..... F23B 30/00 122/16.1
8,161,959 B1 4/2012 O'Reilly
8,186,286 B2 * 5/2012 Brazier ..... F23G 5/12 110/173 R
9,182,115 B2 * 11/2015 Dongo ..... F23B 40/08
9,182,116 B2 * 11/2015 Murray ..... F23B 60/02
2005/0133202 A1 6/2005 Jorgensen et al.
2010/0276128 A1 11/2010 Taylor
2010/0300378 A1 12/2010 Rigamonti
2013/0125838 A1 5/2013 Min
2013/0186313 A1 * 7/2013 Walborn ..... F24H 1/108 110/345

FOREIGN PATENT DOCUMENTS

KR 20020044625 A 6/2002
KR 20140037560 A 3/2014
WO 2012124879 A1 9/2012

OTHER PUBLICATIONS

Munchkin Stainless Steel High Efficiency Boiler; Heat Transfer Products, Inc.; pp. 76; Dated Feb. 20, 2007.

* cited by examiner

BOILER WITH ACCESS TO HEAT EXCHANGERS

PRIORITY CLAIM

This application is a Utility Patent application based on a previously filed U.S. Provisional Patent Application U.S. Ser. No. 62/143,646 filed on Apr. 6, 2015, entitled BOILER WITH ACCESS TO HEAT EXCHANGERS, the benefit of the filing date of which is hereby claimed under 35 U.S.C. § 119(e) and which is further incorporated by reference in its entirety.

TECHNICAL FIELD OF THE INVENTION

The disclosure relates generally to heat transfer technologies and more specifically to boilers with access to the heat exchangers.

BACKGROUND OF THE INVENTION

Boilers are structures in which water or another fluid is heated via heat exchangers internal to the boiler. The heated or vaporized fluid is provided to another structure, such as a home, to heat the structure or otherwise generate another form of power. Normally, a fuel is combusted within the boiler and the heat exchangers are subjected to the generated heat. The fluid to be heated is in thermal contact with the heat exchangers. The fuel may be a biomass, such as wood.

Combustion of a biomass fuel generates pollutants, such as soot and ash, which overtime accumulate on the internal heat exchangers. Accordingly, the heat exchangers must be periodically cleaned. Furthermore, the heat exchangers include weld joints. Due to the extreme heat generated within a boiler, the exchangers and weld joints must be routinely inspected for damage. In typical boilers, the only route of access to the heat exchangers is from the exterior of the boiler, such as through the exhaust or cutting through an exterior wall. Inspecting, repairing, cleaning, and other maintenance of the heat exchangers from the exterior of the boiler is difficult and/or cumbersome. It is for these and other concerns that the present disclosure is offered.

SUMMARY OF THE INVENTION

The present disclosure is directed towards a boiler that includes a housing. The housing houses a combustion chamber, a heat exchanger system, an isolating member, and an access panel. The combustion chamber houses a combustion of fuel. The combustion of fuel generates thermal energy. The heat exchanger system receives at least a portion of the generated thermal energy. The heat flow path provides at least a portion of the generated thermal energy from the combustion chamber to the heat exchanger system. The isolating member includes an aperture. Furthermore, the isolating member at least partially physically separates the combustion chamber from the heat exchanger system. The aperture is sized to provide a user access to the heat exchanger system from the combustion chamber. When the access panel is in a first position, the access panel at least partially covers the aperture to prohibit the user access to the heat exchanger system. When the access panel is in a second position, the aperture is uncovered by the access panel such that the user may access the heat exchanger system from the combustion chamber.

In various embodiments, the boiler further includes a water jacket that thermally couples water within the water jacket to the heat exchanger system. The heat exchanger system may includes a plurality of radiator-like fins. At least a portion of the water within the water jacket is on an internal side of at least one of the plurality of fins and the thermal energy provided by the heat flow path is on an external side of the fin, such that the fin physically separates the water from the thermal energy but thermally couples the water to the thermal energy In some embodiments, the access panel is a removable panel. For instance, the access panel is enabled to be completely removed from the isolating member. The heat exchanger system may not be accessible from an exterior of the boiler. The isolating member may be substantially a vertical member that is positioned intermediate the combustion chamber and the heat exchanger system.

Some embodiments further include a reaction chamber. The reaction chamber may be vertically below the combustion chamber. A secondary combustion process may occur in the reaction chamber. The heat flow path provides at least a portion of thermal energy generated in the secondary combustion process from the reaction chamber to a lower portion of the heat exchanger system. Some embodiments include comprising a charge tube that provides gasses from the combustion chamber to the reaction chamber. The heat flow path includes a gap positioned in a lower portion of the reaction chamber. The gap enables the flow of gas from the reaction chamber to another chamber that includes at least a portion of the heat exchanger system.

In at least one embodiment, the access panel is a hinged door. The first position of the access panel corresponds to a closed position. The second position of the access panel corresponds to an open position. Some embodiments further include a port. The port provides the user access to the combustion chamber from an exterior of the boiler and when the access panel is in the second position, the user may access the heat exchanger system from the exterior of the boiler.

In other embodiments, a boiler includes a combustion chamber, heat-exchanging structures, and a removable panel. The heat-exchanging structures are thermally coupled to the combustion chamber. The removable panel provides a user access to the heat-exchanging structures. The heat-exchanging structure may be fins or plates.

In some embodiments, the removable panel is positioned on an internal wall of the boiler. In other embodiments, the removable panel is positioned on an external wall of the boiler. The removable panel may be opposing an access port that provides the user access to the combustion chamber. The removable panel may be vertically above a reaction chamber of the boiler.

Various embodiments are directed to a method for servicing a boiler. The boiler includes a plurality of heat exchangers and a panel. When the panel is positioned in a first position, the panel provides access to the plurality of heat exchangers. When the panel is positioned in a second position, the panel prevents access to the plurality of heat exchangers. The method includes transitioning the panel from the second position to the first position, to provide access to the plurality of heat exchangers. The method may include employing a tool through the access to the plurality of heat exchangers to clean the plurality of heat exchangers. In the method may further include transitioning the panel from the first position to the second position, to prevent access to the plurality of the heat exchangers.

In some embodiments, the method includes opening an access port in the boiler to provide access to a combustion chamber of the boiler. In at least one embodiment, the method includes employing the tool through the access to the combustion chamber to clean the plurality of heat exchangers. In at least one embodiment, the method further includes closing the access port in the boiler to prevent access to the combustion chamber.

In some embodiments, the access port is located on an external surface of the boiler. When the panel is positioned in the second position, the panel is located on an internal surface of the boiler. The internal surface opposes the external surface of the boiler. The tool may include at least one of a wire brush, a rake, or a metallic tool. Transitioning the panel from the second position to the first position may include removing the panel from a surface of the boiler.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

To facilitate the understanding of this invention, a number of terms are defined below. Terms defined herein have meanings as commonly understood by a person of ordinary skill in the areas relevant to the present invention. Terms such as "a," "an," and "the" are not intended to refer to only a singular entity, but include the general class of which a specific example may be used for illustration. The terminology herein is used to describe specific embodiments of the invention, but their usage does not delimit the invention, except as outlined in the claims.

Figure 1:
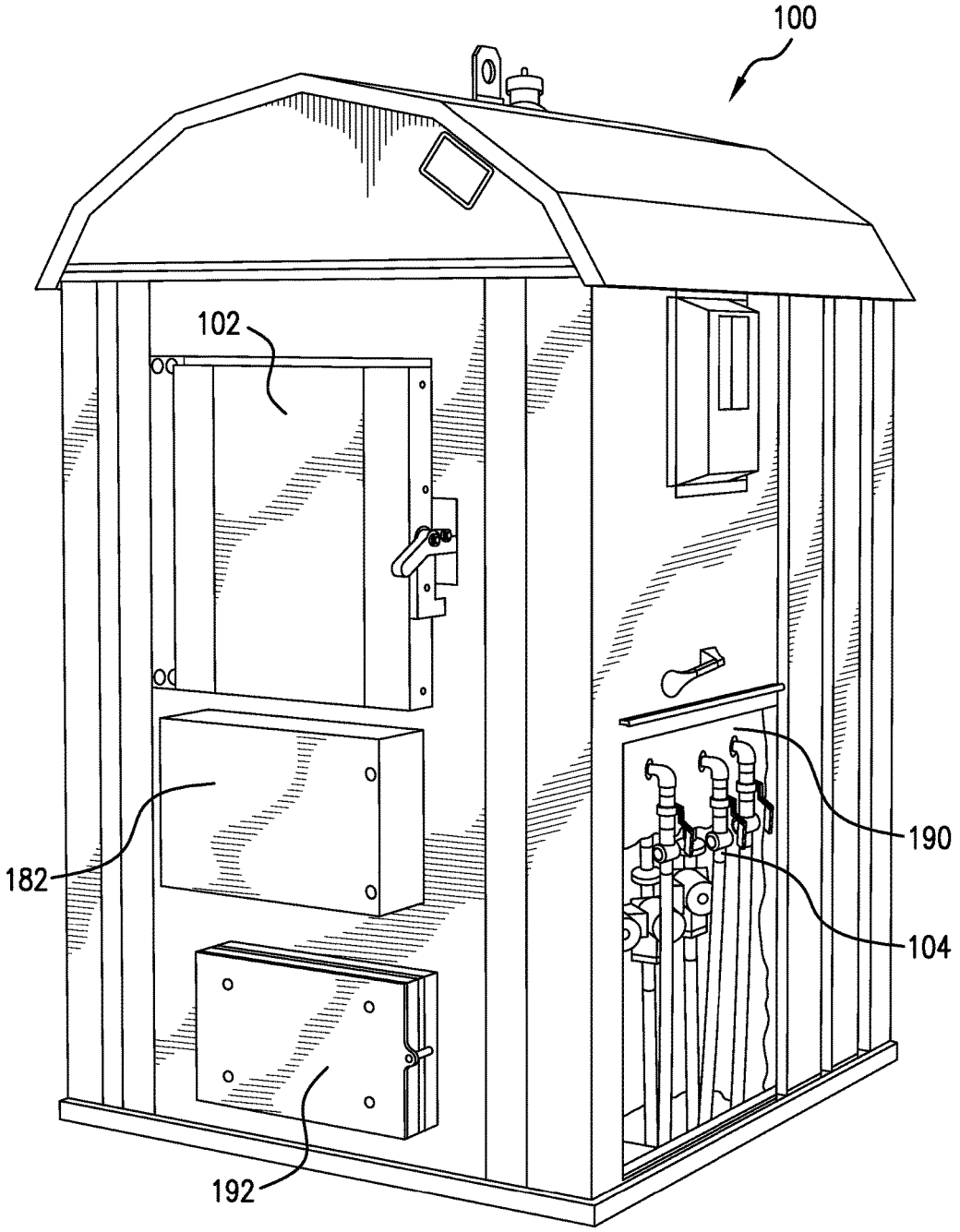
FIG. 1 illustrates an exterior view of a non-limiting exemplary embodiment of a boiler that is consistent with the embodiments disclosed herein.

FIG. 1 illustrates an exterior view of a non-limiting exemplary embodiment of a boiler 100 that is consistent with the embodiments disclosed herein. The exterior view of boiler 100 shows an upper boiler access port 102, a middle boiler access port 182, and a lower boiler access port 192. Each of these boiler access ports 102/182/192 provides access to the interior of boiler 100. The interior of boiler 100 includes multiple combustion chambers where a biomass fuel is sequentially combusted and gasified to release the energy required to heat or vaporize the water within a water jacket that is internal to boiler 100.

The upper boiler access port 102 includes a hinged door that is closed in FIG. 1. Upper access port 102 provides access to a firebox or primary combustion chamber of boiler 100. The biomass fuel is loaded into the boiler 100 via upper boiler access port 102. Middle boiler access port 182 and lower boiler access port 192 provide access to a charge tube and a reaction chamber respectively. As discussed further below, the primary combustion chamber, the charge tube, and the reaction chamber provide a sequence of progressive combustion/gasification chambers. Each of the chambers may be periodically cleaned via the access provided by the boiler access ports 102/182/192/

FIG. 1 shows plumbing 104. The heated and/or vaporized water leaves boiler 100 through plumbing 104 and is provided to a structure to be heated, such as a home. Also illustrated in FIG. 1 is the thermal insulation 190 that is included in boiler's 100 housing. Thermal insulation 190 ensures that a minimal amount of heat energy released in the combustion/gasification chambers escapes to the external environment.

Figure 2:
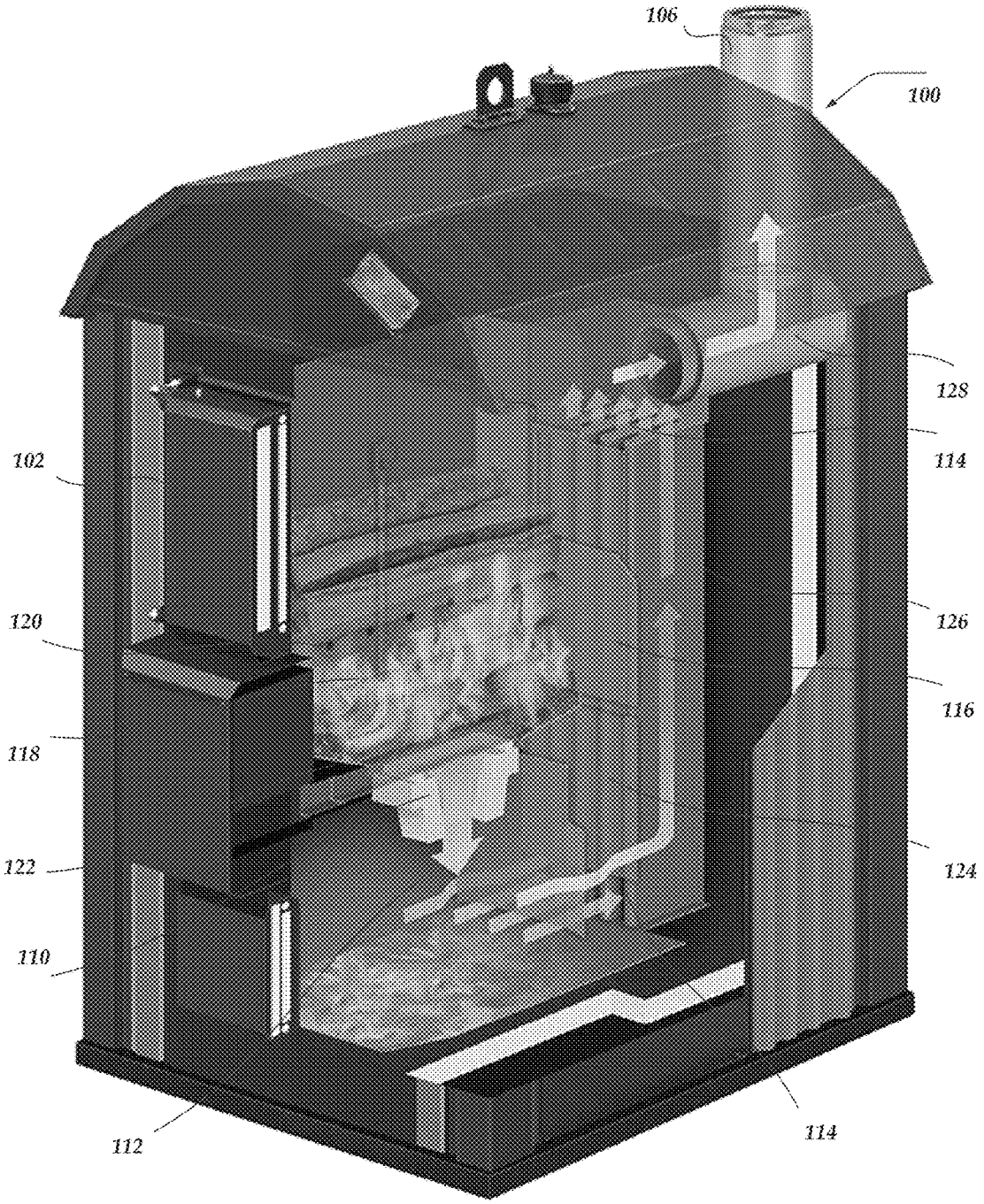
FIG. 2 illustrates a cutaway view to the interior of the boiler of FIG. 1.

FIG. 2 illustrates a cutaway view to the interior of boiler 100 of FIG. 1. Boiler 100 includes an insulated chimney 106 to expel the exhaust and/or heated gases generated from the combustion of the biomass fuel and after the exhaust has heated and/or vaporized water that is contained in water jacket 126. In some embodiments, additional chimney sections are provided for extending chimney 106. Upper boiler access port 102 is also shown FIG. 1.

Biomass fuel, such as wood, is combusted within the firebox or primary combustion channel 118. A crossfire air system 120 injects preheated air around the base of the primary combustion chamber 118. The bottom portion of primary combustion chamber includes an ash pan 122 with a recessed portion from collecting debris from the combustion process. Ash pan 122 enables the easy cleanup, via the upper boiler access port 102, of coals, ash, and other byproducts generated by the combustion of the biofuel.

As the wood begins to gasify, the gases flow downward through a port in ash pan 122. The combustion gasses are added to the heated oxygen in the charge tube 110, wherein a secondary combustion process occurs. As the vertically downward arrow indicates, the heated gasses are forced downward into the reaction chamber 112, where the final combustion occurs.

An isolating member, such as panel 124 physically separates or isolates the primary combustion chamber 118 and the reaction chamber 112 from the heat exchangers 114. As shown by the heat flow arrows, the heated gasses flow from the reaction chamber 112 to the heat exchangers 114 via a gap in the bottom portion of separation or isolating panel 124. These heated gasses transfer heat to the heat exchangers 114, which in turn transfers at least a portion of the heat to water that is supplied to another structure via plumbing, such as plumbing 104 of FIG. 1.

Boiler 100 includes a water jacket 126. Water jacket 126 is essentially a closed system that houses the heated water to be supplied to the other structure. At least a portion of the water jacket 126 is thermally coupled to heat exchangers 114 so that the water internal to water jacket 126 is heated and/or vaporized via the heat released by the combustion of the biomass. The heated water within the water jacket 126 is circulated away from boiler 100 and provided to the structure via plumbing. After providing at least a portion of the energy to the other structure, the water is circulated back to boiler 100 to be re-thermally energized.

Heat exchangers 114 include vertical radiator-style fins. In other embodiments, heat exchangers 114 may include fabricated plates. The plates may include a significant surface area to promote efficient heat exchange. The plates may be metal plates. In at least one embodiment, heat exchangers 114 include other heat radiating structures. The increased surface area of these fins provides a greater surface area to thermally couple the heat exchangers 114 to the water within water jacket 126. The fins define an interface between the flowing heated gasses and the water within water jacket 126. In at least one embodiment, at least a portion of water jacket 126 may include internal channels, pipes, or other plumbing that is internal to the vertical fins. In other embodiments, the heat gasses flow through internal channels within the fins and the water jacket 126 is on the other side of a wall of the fins. The heat flow arrows show the heat flowing through the vertical fins of the heat exchangers 114, up through an exhaust duct 128 and out through chimney 106.

Panel 124 includes a removable section 116 that provides access from the interior of boiler 100 to the heat exchangers 114. Specifically, the removable section 116 provides access to the heat exchangers 114 from the primary combustion chamber 118. Removable section 116 may be a removable door, hatch, panel, or other sectional member that can be removed to provide access from the primary combustion chamber 118 to the heat exchangers 114. In some non-limiting embodiments, the heat exchangers 114 are not accessible, except through removable panel 116. For instance, the exterior of boiler 100 provides no access to the heat exchangers 114. Removable panel 116 may be a hinged panel, or else may be completely removable. In other embodiments, removable panel 116 may not be completely removable, but is hinged, to provide access from the primary combustion chamber 118 to the heat exchangers 114, such as in a hinged door fashion. The hinge may be positioned along a vertical edge of removable panel 116 or a horizontal edge of removable panel 116.

In other embodiments, access to the heat exchangers 114 is provided by a removable panel positioned on an exterior wall of boiler 100, rather than a removable panel on an internal surface of boiler 100, such as removable panel 116 positioned on an interior wall or panel 124. For instance, a removable panel may be positioned on an exterior wall of the housing of boiler 100, where the exterior wall is near or adjacent to the heat exchangers 114 within boiler 100. In this way, a user is provided similar access to the heat exchangers 114 from outside of or exterior to boiler 100. In at least one embodiment, boiler 100 includes access to the heat exchangers 114 from both within (or internal to) boiler 100, via removable panel 116, and also exterior to boiler 100. The exterior access is provided via a removable panel positioned on an exterior wall of the housing of boiler 100. Accordingly, in some embodiments, a user may access the heat exchangers 114 from both the interior and exterior of boiler 100, and from two separate and distinct removable panels.

Because of the flow of the combustion gasses from the primary combustion chambers 118, through the charge tube 110 and reaction chamber 112, and across the heat exchangers 114, the heat exchangers accumulate soot and ash over time and require periodic cleaning. To clean the heat exchangers 114, a user needs only to access the heat exchangers 114 via the one or more removable panels. For instance, a user can access the heat exchangers 114 from within boiler 100 via removable panel 116. In other embodiments, the user can access heat exchangers from the exterior of boiler 100, via a removable panel positioned on the exterior surface of boiler 100. Removable panel 116 provides access to the vertical fins of heat exchangers 114. With the removable panel 116 removed, the user may clean the heat exchangers 114 with a tool, such as a metallic cleaning tool, wire brush, rake, or another specialized tool.

Periodic inspection and maintenance may also be performed by removing removable panel 116. The removable panel 116 obviates the need for a panel providing access to the heat exchangers 114 from the exterior of boiler 100. Thus, in some embodiments, the only path between the exterior of boiler 100 and the heat exchangers 114 is through the heated gas flow path from chimney 106, through exhaust duct 128 and to heat exchangers 114. In other embodiments, an exterior removable panel provides access to the heat exchangers for periodic maintenance and inspection.

Furthermore, a removable panel enables a simplified construction and/or maintenance of boiler 100. For instance, heat exchangers may be welded from within the firebox or primary combustion chamber 118 and outside of water jacket 126 via removable internal panel 116. Since all the welds are accessible from the primary combustion chamber 118 by removing removable panel 116, each of the welds may be repaired during regular maintenance via the access provided by a removable panel.

Figure 3:
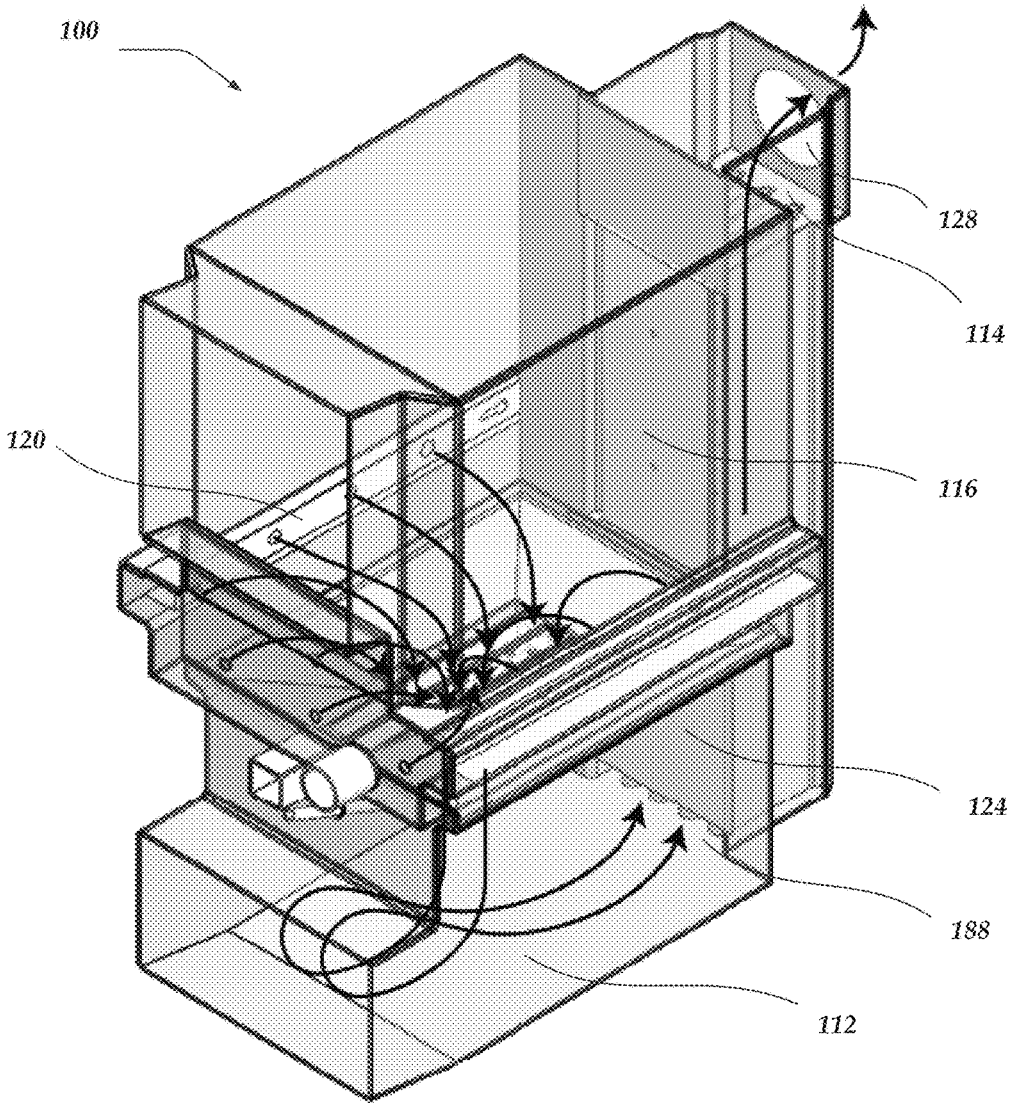
FIG. 3 provides another cutaway view to the interior of the boiler of FIG. 1 that illustrates the heat flow of the combustion/gasification process.

FIG. 3 provides another cutaway view to the interior of boiler 100 of FIG. 1 that illustrates the heat flow of the combustion/gasification process. The crossfire air system 120 adds or injects preheated air to the base of the firebox. The gasified wood flows through the charge tube and into the reaction chamber 112, where the final combustion/gasification occurs. The heated gas flows through gap 188 at the lower portion of the separation panel 124.

The heat flows through or around the vertical radiator fins of heat exchangers 114 to provide heat energy to the water in the water jacket. The heat flows through the upper portion of heat exchangers 114 and out through exhaust duct 128. Removable panel 116 is clearly shown in FIG. 3. Removable panel 116 provides access to heat exchangers 114 through the interior of boiler 100.

Figure 4:
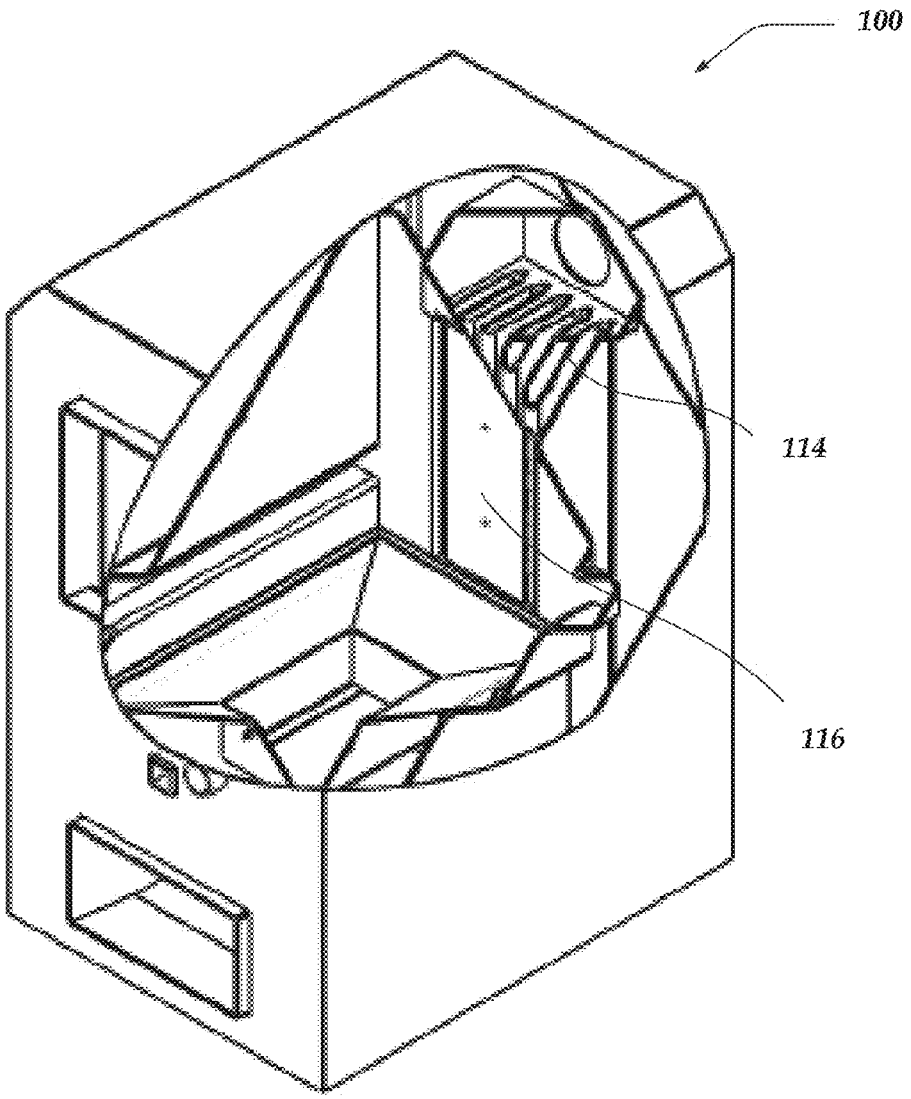
FIG. 4 provides another cutaway view to the interior of boiler of FIG. 1 that illustrates the removable panel that provides access to the heat exchangers from the interior of the boiler.
Figure 5A:
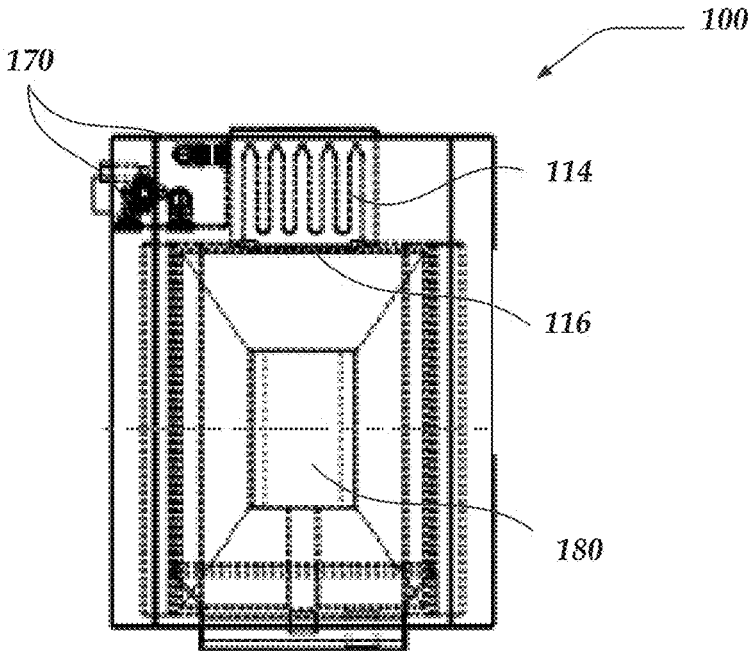
FIG. 5A shows a top view of the interior of the boiler of FIG. 1.

FIG. 4 provides another cutaway view to the interior of boiler 100 of FIG. 1 that illustrates the removable panel 116 that provides access to the heat exchangers 114 from the interior of the boiler 100. FIG. 5A shows a top view of the interior of boiler 100 of FIG. 1. FIG. 5A provides a top view of the recessed portion 180 of the ash pan in the primary combustion chamber. The removable panel 116 that provides access from the interior of boiler 100 to heat exchangers 114 is shown. Portions of piping 170 of the water jacket is shown. These portions provide access to the spaces within the radiator fins of heat exchangers such that the water is heated/vaporized from the heat flowing through heat exchangers 114.

Figure 5B:
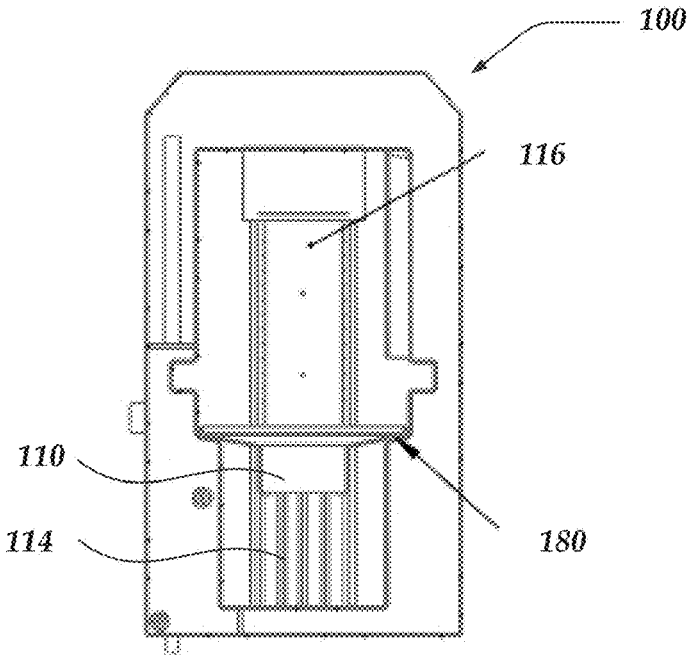
FIG. 5B provides a frontal view of the interior of the interior of the boiler of FIG. 1.
Figure 6:
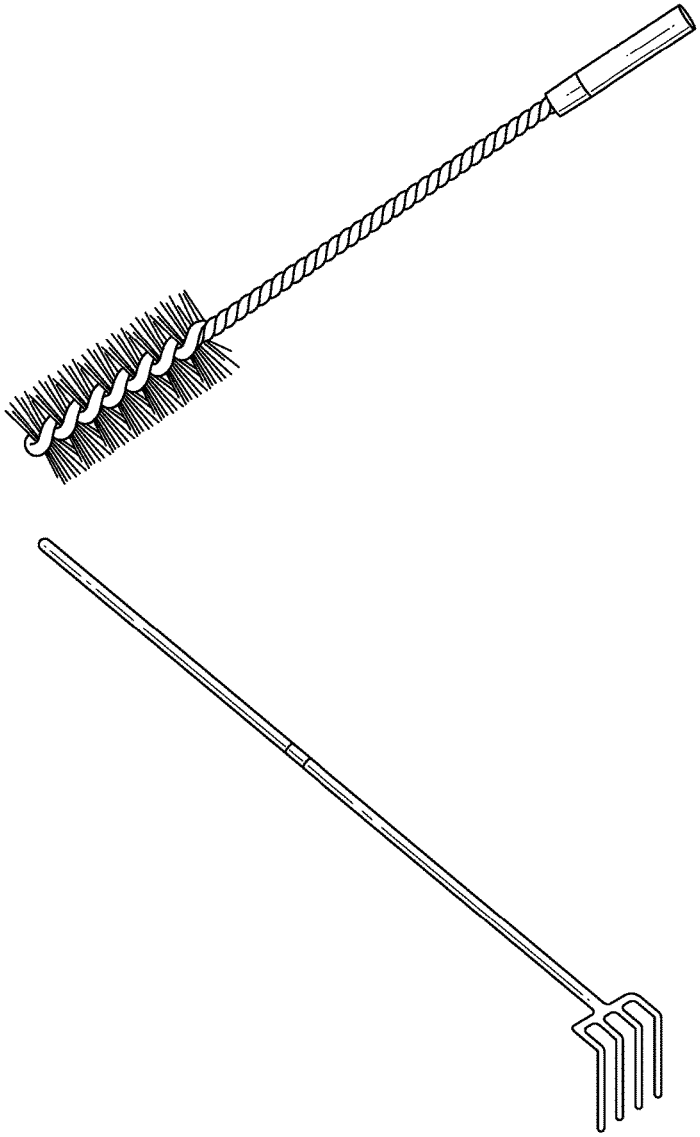
FIG. 6 shows side views of an example wire brush and an example rake.

FIG. 5B provides a frontal view of the interior of the interior of boiler 100 of FIG. 1. The recessed portion 180 of the ash pan of the primary combustion chamber is visible, as well as the charge tube 110. Removable panel 116 provides access to the heat exchangers 114.

All of the embodiments and methods disclosed and claimed herein can be made and executed without undue experimentation in light of the present disclosure. While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A boiler including:

a housing that houses:

a combustion chamber that houses a combustion of fuel, wherein the combustion of fuel generates thermal energy;

a heat exchanger system that receives at least a portion of the generated thermal energy;

a heat flow path that provides at least a portion of the generated thermal energy from the combustion chamber to the heat exchanger system;

an isolating member that includes an aperture and at least partially physically separates the combustion chamber from the heat exchanger system, wherein the aperture is sized to provide a user access to the heat exchanger system from the combustion chamber; and an access panel that, when in a first position, at least partially covers the aperture to prohibit the user access to the heat exchanger system and, when the access panel is in a second position, the aperture is uncovered by the access panel such that the user may access the heat exchanger system from the combustion chamber.

2. The boiler of claim 1, further including a water jacket that thermally couples water within the water jacket to the beat exchanger system and the heat exchanger system includes a plurality of at least one of fins or plates that include a significant surface area, wherein at least a portion of the water within the water jacket is on an internal side of at fins or plates and the thermal energy provided by the heat flow path is on an external side of the fins or plates, such that the fins or plates physically separates the water from the thermal energy but thermally couples the water to the thermal energy.

3. The boiler of claim 1, wherein the access panel is a removable panel such that the access panel is enabled to be completely removed from the isolating member.

4. The boiler of claim 1, wherein the heat exchanger system is not accessible from an exterior of the boiler.

5. The boiler of claim 1, wherein the isolating member is substantially a vertical member positioned intermediate the combustion chamber and the heat exchanger system.

6. The boiler of claim 1, further comprising a reaction chamber that is vertically below the combustion chamber, wherein a secondary combustion process occurs in the reaction chamber and the heat flow path provides at least a portion of thermal energy generated in the secondary combustion process from the reaction chamber to a lower portion of the heat exchanger system.

7. The boiler of claim 6, further comprising a charge tube that provides gasses from the combustion chamber to the reaction chamber.

8. The boiler of claim 6, wherein the heat flow path includes a gap positioned in a lower portion of the reaction chamber that enables the flow of gas from the reaction chamber to another chamber that includes at least a portion of the heat exchanger system.

9. The boiler of claim 1, wherein the access panel is a hinged door, such that the first position of the access panel corresponds to a closed position and the second position of the access panel corresponds to an open position.

10. The boiler of claim 1, further comprising a port that provides the user access to the combustion chamber from an exterior of the boiler and when the access panel is in the second position, the user may access the heat exchanger system from the exterior of the boiler.

11. A boiler comprising:

a combustion chamber;

a plurality of heat-exchanging structures that are thermally, coupled to the combustion chamber; and a removable panel that provides a user access to the plurality of heat-exchanging structures from inside the boiler when the removable panel is in a first position and that prohibits the user access to the plurality of heat-exchanging structures from inside the boiler when the removable panel is in a second position, an entirety of the removable panel being disposed internal to the boiler when the removable panel is in the second position.

12. The boiler of claim 11, wherein the removable panel is positioned on an internal wall of the boiler.

13. The boiler of claim 11, wherein the removable panel is opposing an access port that provides the user access to the combustion chamber.

14. The boiler of claim 11, wherein the removable panel is vertically above a reaction chamber of the boiler.

15. The boiler of claim 11, wherein the removable panel in the second position at least partially physically separates the combustion chamber from the heat-exchanging structures.

16. A method for servicing a boiler that includes a plurality of heat exchangers and a panel that, when positioned in a first position, provides access to the plurality of heat exchangers from inside the boiler and, when positioned in a second position, prevents access to the plurality of heat exchangers, the method comprising:

transitioning the panel from the second position to the first position to provide access to the plurality of heat exchangers from inside the boiler;

employing a tool through the access to the plurality of heat exchanges to clean the plurality of heat exchanges; and transitioning the panel from the first position to the second position to prevent access to the plurality of the heat exchangers, an entirety of the panel being disposed internal to the boiler when the panel is in the second position.

17. The method of claim 16, further comprising:

opening an access port in the boiler to provide access to a combustion chamber of the boiler;

employing the tool through the access to the combustion chamber to clean the plurality of heat exchangers; and closing the access port in the boiler to prevent access to the combustion chamber.

18. The method of claim 17, wherein the access port is located on an external surface of the boiler and, when the panel is positioned in the second position, the panel is located on an internal surface of the boiler that opposes the external surface of the boiler.

19. The method of claim 16, wherein the tool includes at least one of a wire brush or a rake.

20. The method of claim 17, wherein transitioning the panel from the second position to the first position includes removing the panel from a surface of the boiler.

* * * * *